US007348527B2

(12) United States Patent
Braunisch et al.

(10) Patent No.: US 7,348,527 B2
(45) Date of Patent: Mar. 25, 2008

(54) MICROWAVE OVEN HAVING A DOOR VENTILATION SYSTEM

(75) Inventors: Eckart Braunisch, Kimstad (SE); Ulf Nordh, Norrkoping (SE); Per Torngren, Norrkoping (SE); Anders Zeijlon, Norrkoping (SE); Hakan Lundstrom, Norrkoping (SE); Hans Lindgren, Norrkoping (SE); Hakan Carlsson, Norrkoping (SE); Alan D. Bengtson, Saint Joseph, MI (US); Renee M. Garnham, Dearborn, MI (US); Laura E. Petzke, Holland, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 11/556,214

(22) Filed: Nov. 3, 2006

(65) Prior Publication Data

US 2007/0102426 A1 May 10, 2007

(30) Foreign Application Priority Data

Nov. 4, 2005 (EP) ..... 05110335

(51) Int. Cl.
*H05B 6/80* (2006.01)
*F24C 7/02* (2006.01)

(52) U.S. Cl. ..... 219/757; 219/702; 219/739; 219/720; 219/506; 126/21 A

(58) Field of Classification Search ..... 219/702, 219/720, 739, 757, 756, 506; 126/21 A, 126/200

See application file for complete search history.

(56) References Cited

U.S. PATENT DOCUMENTS 4,184,945 A 1/1980 Morgan et al.
6,300,609 B1 * 10/2001 Kim ..... 219/702
6,864,472 B2 3/2005 Kang

FOREIGN PATENT DOCUMENTS

JP 63-264891 * 11/1988 ..... 219/722
JP 8152140 6/1996

OTHER PUBLICATIONS

European Search Report 05110335.6 - 2214 dated Oct. 4, 2006.

* cited by examiner

*Primary Examiner*—Philip H. Leung
(74) *Attorney, Agent, or Firm*—Michael D. Lafrenz; John Morrison

(57) ABSTRACT

A microwave oven for use in cooking food having a door and door mounted controls and a cooling system where the door mounted controls are disclosed. The microwave oven having an external enclosure defining an outer cabinet and an oven cavity supported within the external enclosure where the oven cavity has a front access opening. The door is rotatably supported adjacent the external enclosure for selectively closing the access opening. A control unit is mounted within the door and a ventilation cooling path is formed within the door for cooling the control unit mounted with the door. A blower is supported within the external enclosure for directing an air flow toward the door and into the ventilation cooling path. The microwave can further include a housing which is supported within the door for enclosing the control unit and where the housing forms part of the ventilation cooling path. A baffle is disposed within the housing wherein the housing and the baffle direct the air flow initially upwardly and then downwardly to pass along the control unit.

12 Claims, 7 Drawing Sheets

MICROWAVE OVEN HAVING A DOOR VENTILATION SYSTEM

BACKGROUND OF THE INVENTION

1. Field of the Invention

The present invention relates to a microwave oven, and more specifically to a ventilation system for a microwave oven door.

2. Description of the Related Art

Conventional microwave ovens are generally classified into several different types including: tabletop microwave ovens designed to be seated on a table and/or countertop; and a ventilation hood-combined microwave oven designed to be mounted above a oven range—sometimes referred to as Over-The-Range (OTR) microwaves. An OTR microwave includes a ventilation hood type system for exhausting hot air, steam, smoke, etc. generated from the oven range.

In general, microwave ovens are provided with ventilation systems for dissipating heat which may build up during cooking. When the microwave oven is mounted within a wall above a conventional oven, such as in an OTR microwave, the problem of dissipating heat generated during cooking is increased. The heat dissipation problem is especially difficult when the lower oven is in an open-door broiling operation and a microwave oven mounted above the conventional oven is also operating. During this operation, heat rises from the lower conventional oven and can heat the electronic components of the microwave oven which are already in a heated condition due to their normal operation.

It is known in microwave ovens to provide an air circulation system to provide a cooling for various electrical components such as the power transformer and the magnetron and then to direct the air through the cooking cavity to a discharge region. An example of a known system for cooling the electrical compartment of a microwave is shown in U.S. Pat. No. 6,864,472.

In addition to cooling electrical components such as power transformers and magnetrons, it is also known to provide ventilation systems for cooling control elements, such as the electronic control elements associated with the microwave control. U.S. Pat. No. 4,184,945, discloses an air flow system for use in a wall-mount microwave oven and for cooling an electronic component compartment. A front face of the housing is comprised of a movable door and a control panel. A circuit board for holding electronic components is mounted parallel and in a spaced relationship from the control panel. An air passageway is defined in the area between the control panel and the circuit board. An air inlet is disposed adjacent an upper end of the control panel for admitting air into the electrical component compartment and an air outlet is disposed adjacent a lower end of the control panel for allowing air to exit from the electrical component compartment. A blower draws air in through the air inlet, and forces the air through the electrical component compartment and out the air outlet.

In Japanese patent JP8152140, a system is disclosed for cooling a door of a heating cooker, where the door of the heating cooker is hingedly supported to a cabinet. When the door is in a closed state, a lower air path, a spacing inside the door and an upper air path communicates with each other to form a cooling air circulation path.

SUMMARY OF THE INVENTION

In some circumstances, it is desirable to mount control elements for microwave ovens on the microwave door. In this case, it would be desirable to have a ventilation system for a microwave oven that provided cooling for the door mounted controls.

One aspect of the present invention provides a system for cooling door mounted controls in a simple and effective manner. A microwave oven for use in cooking food is provided with an external enclosure defining an outer cabinet and an oven cavity supported within the external enclosure. The oven cavity has a front access opening and a door is rotatably supported adjacent the external enclosure for selectively closing the access opening. A control unit is mounted within the door and a ventilation cooling path is formed within the door for cooling the control unit mounted with the door. A blower is supported within the external enclosure for directing an air flow toward the door and into the ventilation cooling path.

The microwave oven may include a housing which is supported within the door for enclosing the control unit where the housing forms part of the ventilation cooling path. A baffle is disposed within the housing wherein the housing and the baffle direct the air flow initially upwardly and then downwardly to pass along the control unit.

Advantageously, an electrical equipment compartment is disposed within external enclosure and the blower is supported within the external enclosure for causing air flow into the electrical equipment compartment. Operation of the blower causes a positive air pressure within the electrical equipment compartment and an air conduit extends from the electrical equipment compartment toward the front surface of the external enclosure for directing air flow toward the door.

BRIEF DESCRIPTION OF THE DRAWINGS

The present invention will be more apparent from the accompanying drawings, which are provided by way of non-limiting example and in which.

DETAILED DESCRIPTION OF TE PREFERRED EMBODIMENTS

With reference to the drawings, there is shown a ventilation hood-combined microwave oven 10 designed to be mounted to a wall above an oven range, sometimes referred to as an Over-The-Range (OTR) microwave or wall mounted type microwave, in accordance with the present invention.

Figure 1:
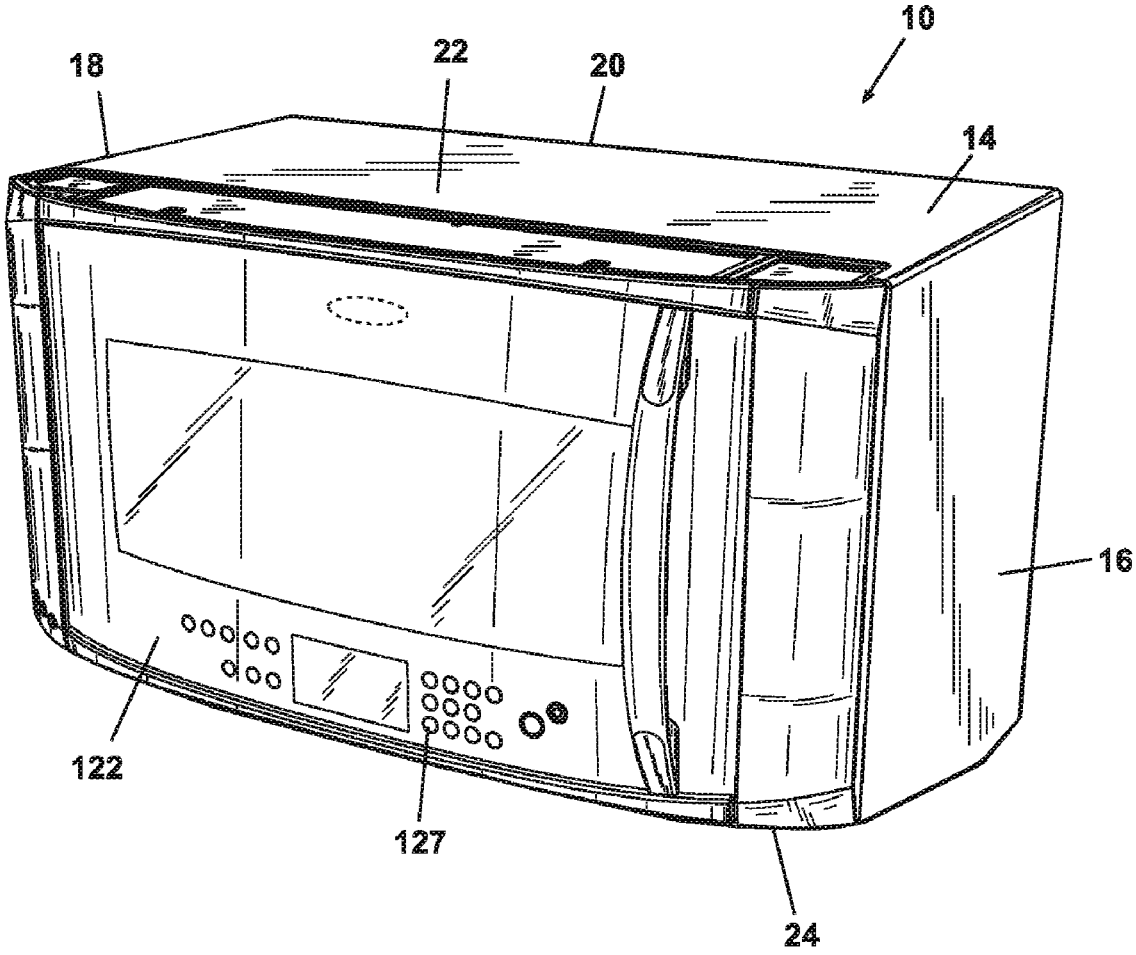
FIG. 1 is a top, front perspective view of a microwave oven embodying the principles of the present invention.
Figure 2:
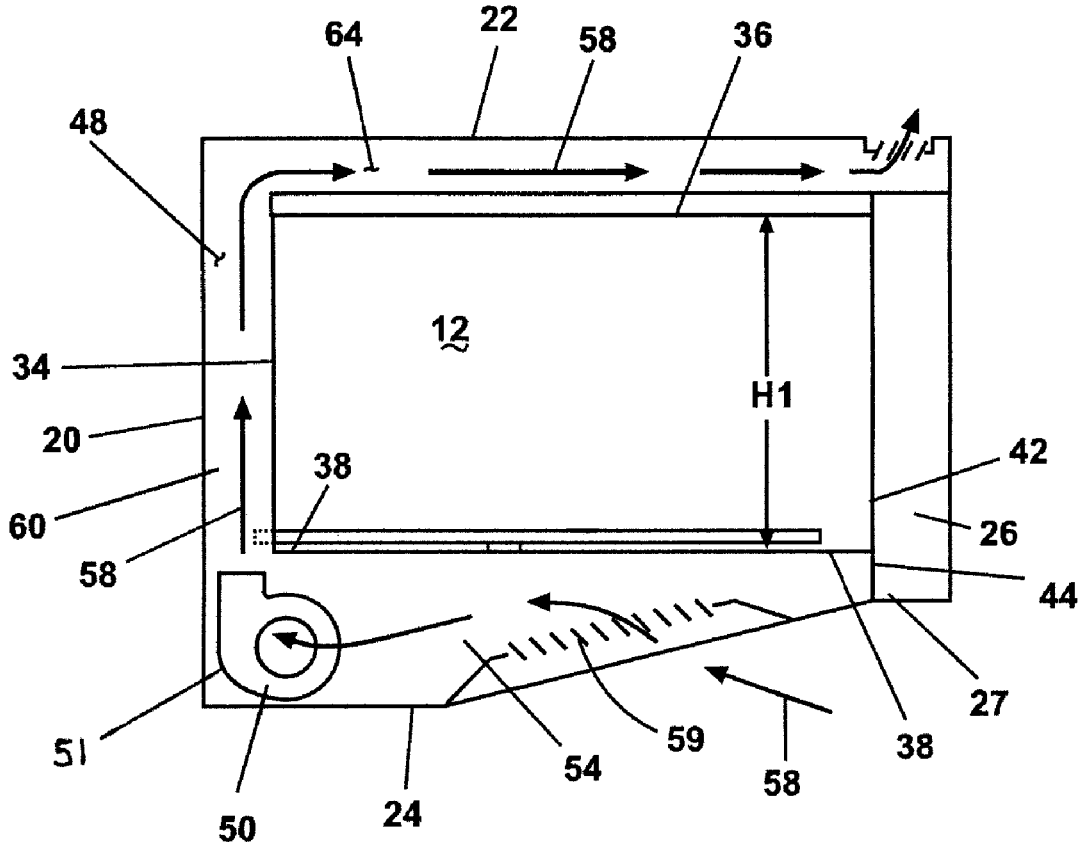
FIG. 2 is a side cross-sectional view of the microwave oven of FIG. 1, showing the exhaust air flow path within the microwave oven of the present invention.

Looking at FIGS. 1 and 2, it can be seen that the microwave oven 10 includes an oven cavity 12 which is provided within an exterior enclosure or outer case 14. The enclosure 14 includes side walls 16, 18, rear wall 20, a top wall 22 and a bottom closure wall 24. The front face or surface of the enclosure 14 is formed by a pivotable door 26 which may have a curved or bowed out shape.

The oven cavity 12 includes side walls 30 and 32, rear wall 34, a top wall 36 and a bottom wall 38. The cavity 12 is provided with a front access opening 42 closable through operation of the pivotable door 26. The cavity 12 is provided with a cavity front surface 44 provided about the front access opening 42 wherein the cavity front surface 44 abuts the door 26 when the door 26 is in a closed position.

An exhaust ventilation system is also provided as part of the microwave oven 10. The exhaust ventilation system includes an air exhaust path, referred to as 48, which includes a bottom plenum 54, rear air channels 60 and 62, and an upper air plenum 64. A blower 50 is located along the rear portion of the air plenum or space 54 which is formed between the bottom closure wall 24 of the enclosure 14 and the bottom wall 38 of the microwave oven cavity 12. The blower 50 includes a blower wheel which has its longitudinal axis extending parallel to the plane occupied by the rear wall 34 and bottom wall 38 of the oven cavity 12. The blower wheel is carried within an air channeling housings 51. While one blower 50 is shown, two blowers can also be used, or a pair of blower wheels driven by a single motor.

Air is drawn or sucked into the exhaust ventilation system by the blower 50 through a suction grill or opening 59. The suction opening 59 is provided in the bottom closure wall 24. A filter may be provided adjacent the suction opening 59 for filtering air as it passes into the air exhaust path 48. After passing through the blower 50, the air stream is directed upwardly through rear air channel 60, and forward through an upper air plenum 64, and vented back into the kitchen ambient environment. Alternatively, the exhaust air may be directed to an external outside vent.

Figure 3:
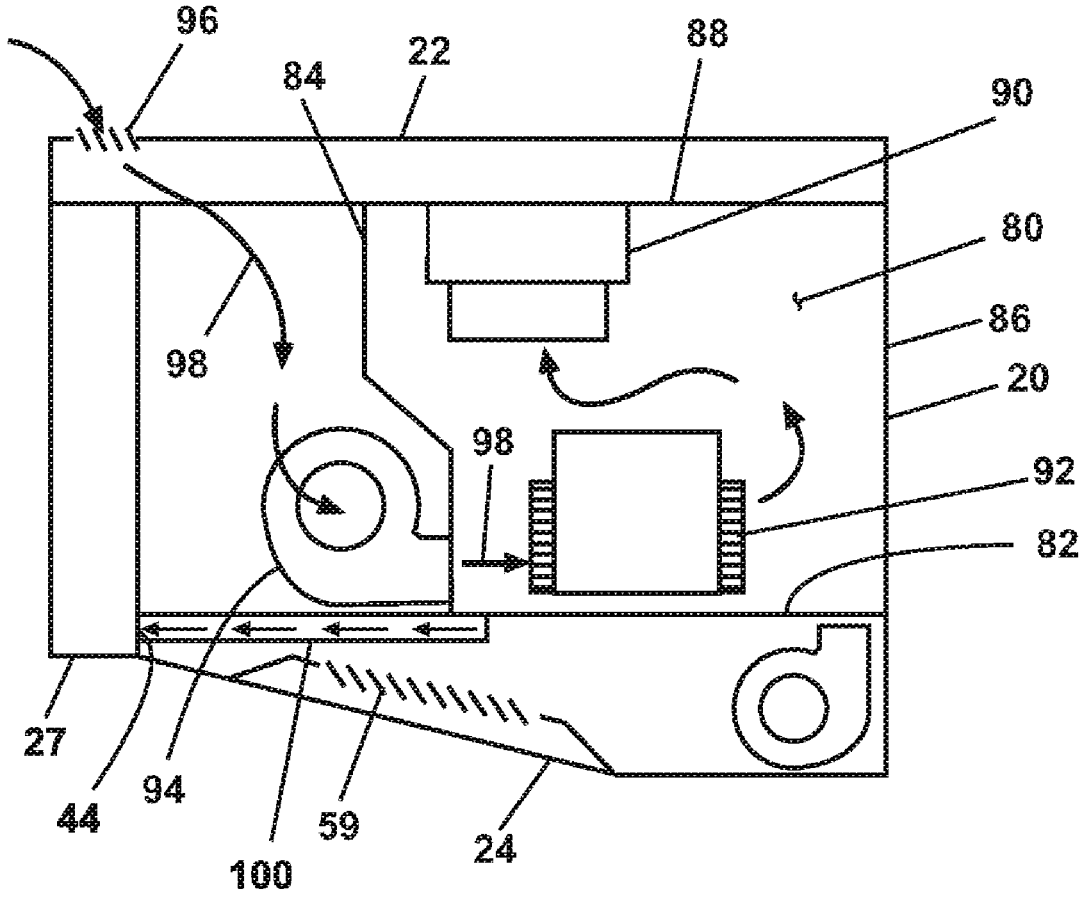
FIG. 3 is a side cross-sectional view of the microwave oven of FIG. 1, showing the cooling air flow path within the microwave oven of the present invention.

Disposed within the enclosure 14 of the microwave 10 is electrical equipment chamber 80 as shown in FIG. 3. This electrical equipment chamber 80 may be positioned along the side of the oven cavity 12. The electrical equipment chamber 80 is defined by a bottom wall 82, a front wall 84 a rear wall 86 and a top wall 88. The side walls 16 and 30 may provide further enclosure walls to complete the electrical equipment chamber 80. Electrical equipment for generating a microwave in order to heat food items within the oven cavity 12 are installed in the electrical equipment chamber 80. For example, a magnetron 90 and a high voltage transformer 92 may be provided within the electrical equipment chamber 80 along with other electrical items.

Mounted to the electrical equipment chamber 80 is a cooling fan or blower 94. The cooling blower 94 is operated to draw air into the first side compartment through a top, inlet vent opening area 96 and direct this cooling air stream 98 into the electrical equipment chamber 80. The cooling air stream 98 may then pass over and around the electrical components provided within the electrical equipment chamber 80 and then pass through the magnetron 90 into the oven cavity 12 or through an air channel (not shown) above the oven cavity 12.

As shown in FIGS. 3-6, the present invention provides a ventilation system for cooling controls which are mounted onto the door 26. The controls may be of any type and may be electronic or electro-mechanical controls. The controls may be formed as a electronic control unit 120 which is supported behind a glass panel 122 which forms the entire front surface of the door 26. The electronic control unit 120 includes a liquid crystal display 123 on which character data or image data are displayed in plural display areas and a transparent electrode switch sheet 125 in which there are arranged plural transparent electrode switches. Keys 127 (see FIG. 1) of the electronic control unit 120 are formed by overlaying the transparent electrode switch sheet to the liquid crystal display such that each electrode switch of the overlaid transparent electrode switch sheet corresponds to the position of one of the plural display areas of the liquid crystal display which is visible through the glass panel 122. Within the door 26, a ventilation cooling path 128 is provided for cooling the control unit 120.

Figure 4:
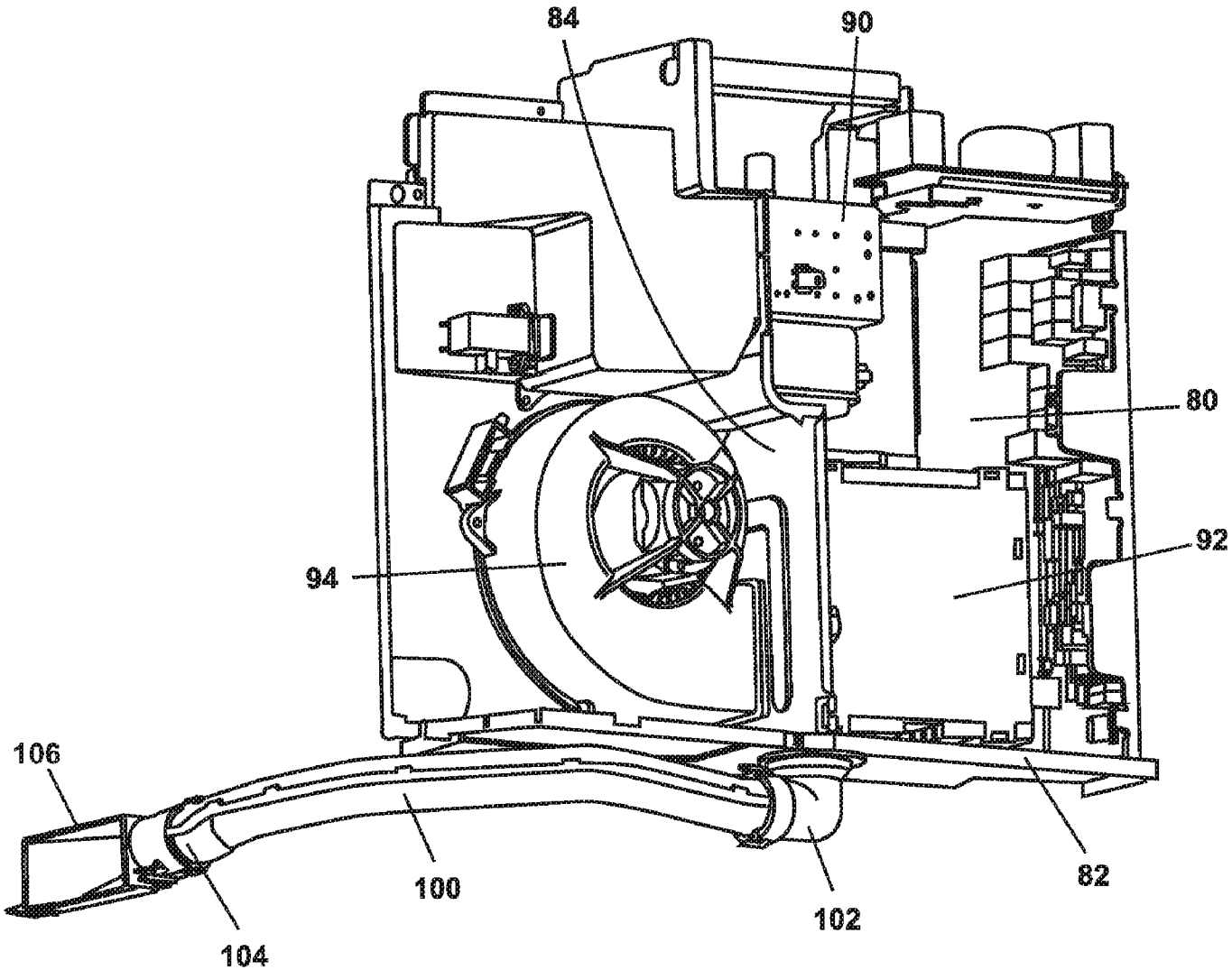
FIG. 4 is a detailed front, right perspective view of the electrical compartment of the microwave oven of the present invention, including the air conduit for supplying air flow to the door.

The ventilation cooling path 128 is supplied with air flow by a system, best shown in FIGS. 3 and 4, for directing air flow to the door 26. For clarity, in FIG. 4 the cavity 12 and enclosure 14 have been omitted along with other details. An air conduit 100 is provided extending from the electrical equipment chamber 80 extending forward toward the door 26. Due to the operation of the cooling blower 94, and the restricted openings of the electrical equipment chamber 80, the electrical equipment chamber 80 is pressurized such that air flows outwardly through the air conduit 100. The air conduit 100 may be a tube having a first end portion 102 connected to the electrical equipment chamber 80 and second end portion 104 connected or position adjacent the cavity front surface 44. The second end portion 104 may be connected to a diffuser element 106 which attaches to the cavity front surface 44.

Figure 5:
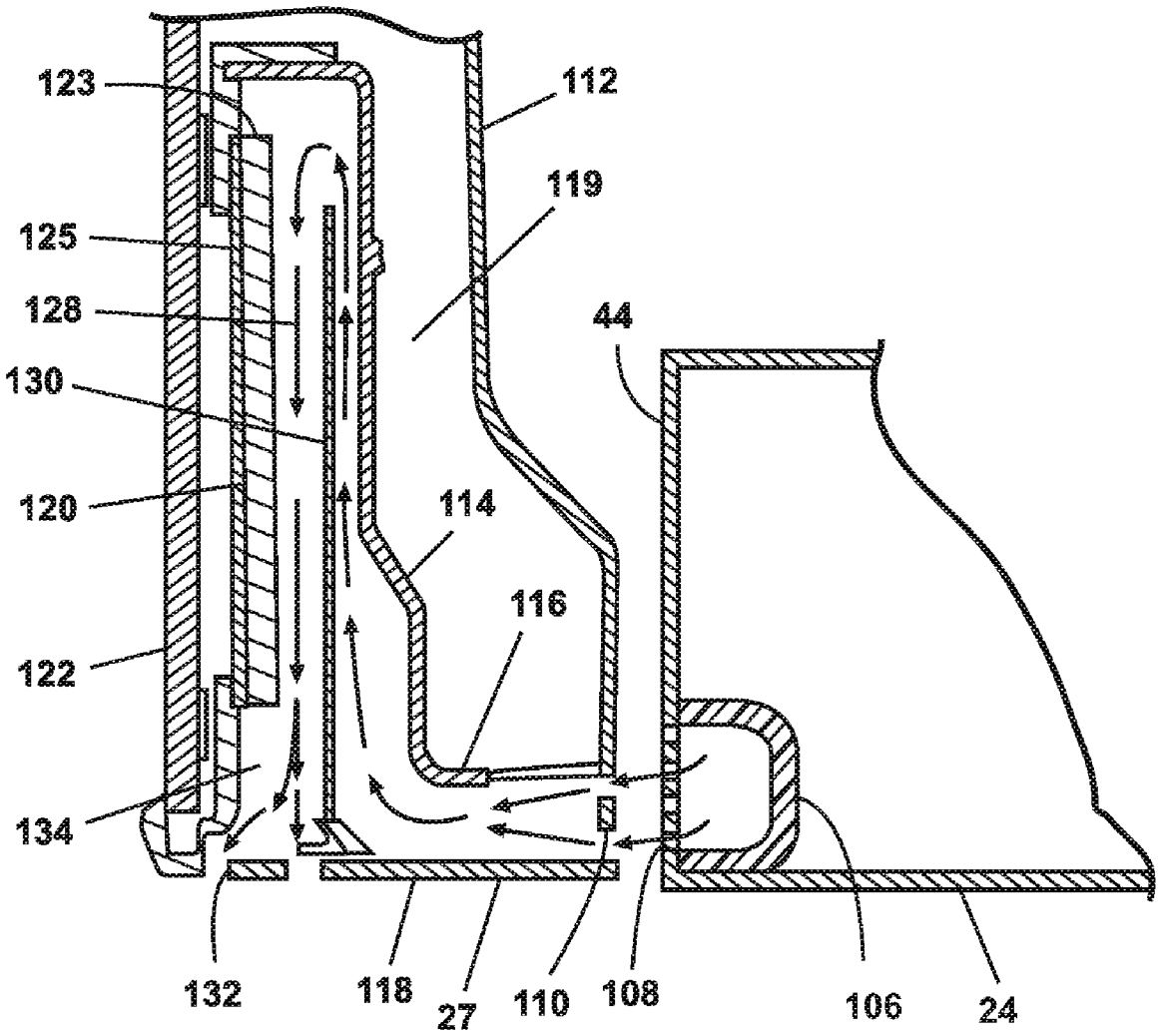
FIG. 5 is a side cross-sectional view of the microwave oven of FIG. 1, showing the cooling air flow path within the bottom portion of the door of the microwave oven of the present invention.
Figure 6:
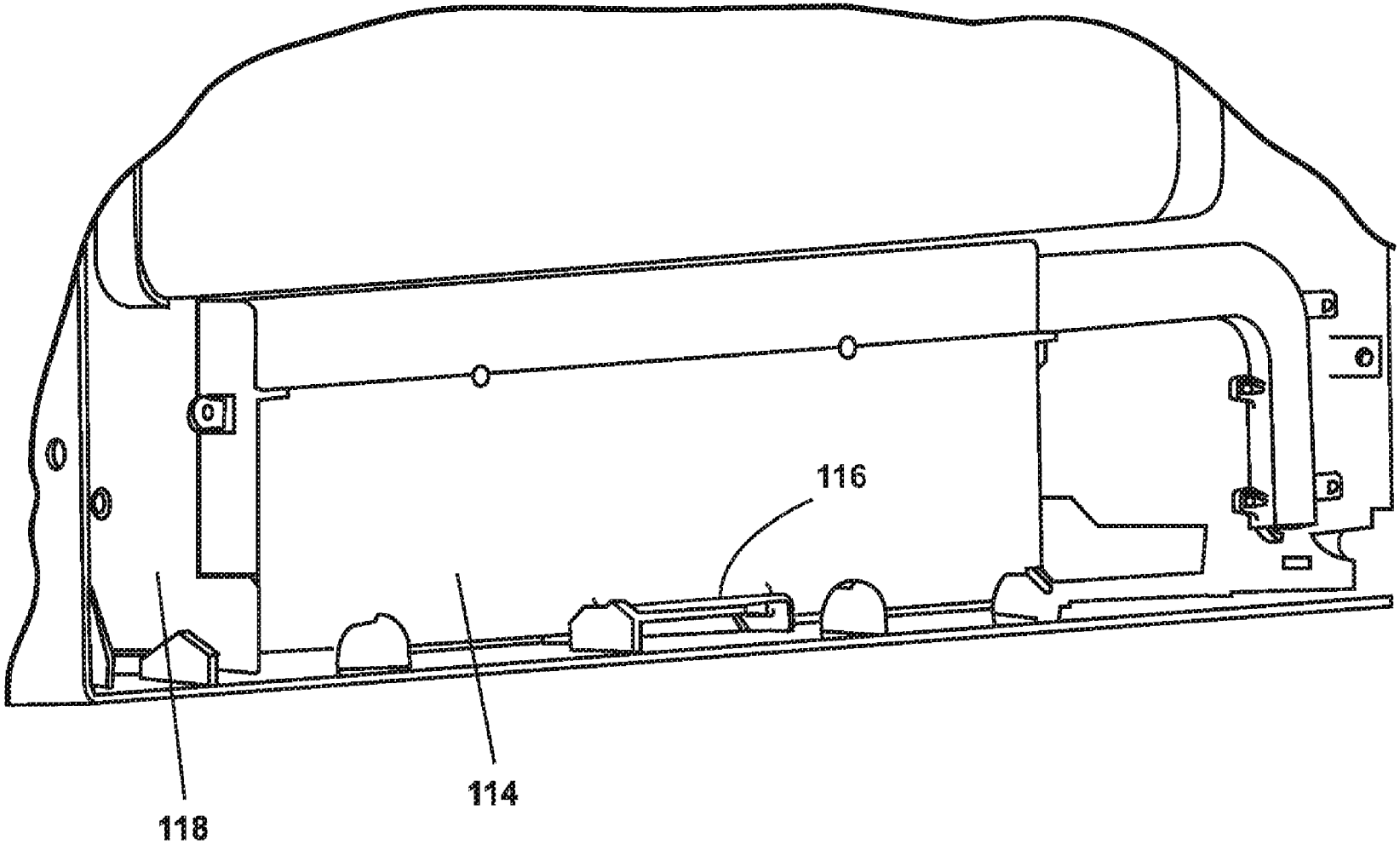
FIG. 6 is a perspective view of the bottom portion of the door of the microwave oven of the present invention, with portions removed to allow viewing of the housing covering the door mounted controls.

As shown in FIGS. 5 and 6, air flow through the conduit 100 is directed to pass through vent exhaust openings 108 provided in the cavity front surface 44 into a bottom edge 27 of the door 26. The cavity vent exhaust openings 108 are positioned adjacent corresponding air vent inlet openings 110 disposed in an inner liner 112 along the bottom edge 27 of the door 26. In this way, air may be passed from the electrical equipment chamber 80 into the door 26 for cooling electronics supported in the door as described herein below. Alternatively, air may be blown into the door from other air flow sources such as a separate fan or blower. Alternate air flow sources capable of supplying air flow to door vent holes 110 may be employed.

Once air flow passes into the door 26 through the door vent holes 110, the air flow is directed into a housing 114 having an inlet 116. The housing 114 is designed to cover and enclose controls which are supported in the door. The housing 114 may be formed from plastic or any suitable material.

The door 26 includes the inner liner 112, the glass panel 122 and a door frame 118 connected together. The inner liner 112 and the door frame 118 are formed having an open center section such that it is possible to look through the glass panel 122 into the oven cavity. The inner liner 112 and door frame 118 connect together and define a peripheral frame area 119 provided about the door 26. As can be appreciated by one skilled in the art, the door 26 may include many additional elements some of which are described herein below and may include an inner glass panel.

Air passing into the housing 114 is first directed upward by an air baffle 130 disposed within the housing 114 in a parallel arrangement to the control unit 120. After flowing upwardly past the air baffle 130, air flow is directly downwardly along the control unit 120. In this way, air flow passes along the surface of the control unit 120 in order to cool the controls and transfer heat away. The ventilation cooling path 128 is formed by housing 114 and the baffle 130. The air flow, heated by the control unit 120, is then directed to exit the housing 114 along a bottom edge.

In one embodiment, air flow is directed to exit the housing 114 and the door 26 and vent directly to the ambient environment. This is accomplished by directing the air flow to pass through exit holes 132 provided in the door frame 118 disposed along the bottom surface of the door 26.

In another embodiment, air flow passing downward past the control unit 120 may be allowed to exit from a bottom portion 134 of the housing 114 and pass into the peripheral frame area 119 of the door 26. In this embodiment, no bottom exit hole 132 is provided but rather, air flow passes from the bottom portion 134 of the housing 114 into the peripheral frame area 119 of the door 26. From the peripheral frame area 119, the exhaust air passes into the ambient environment though various gaps and clearance provided in the door construction between the door frame 118 and the inner liner 112.

One aspect of the invention is a manner in which air flow is directed into the housing 114 supported within the door 26 for enclosing the control unit 120. Air flow directed into housing 114 is channeled to flow along the surface of the control unit 120 and then exit the housing 114. Preferably, the air flow is directed initially upwardly by the baffle 130 and then downwardly along the control unit 120. However, alternatively, the baffle 130 may be omitted and the air flow may pass within the housing upwardly along the control unit 120 and exit along a top edge of the housing 114.

Figure 7:
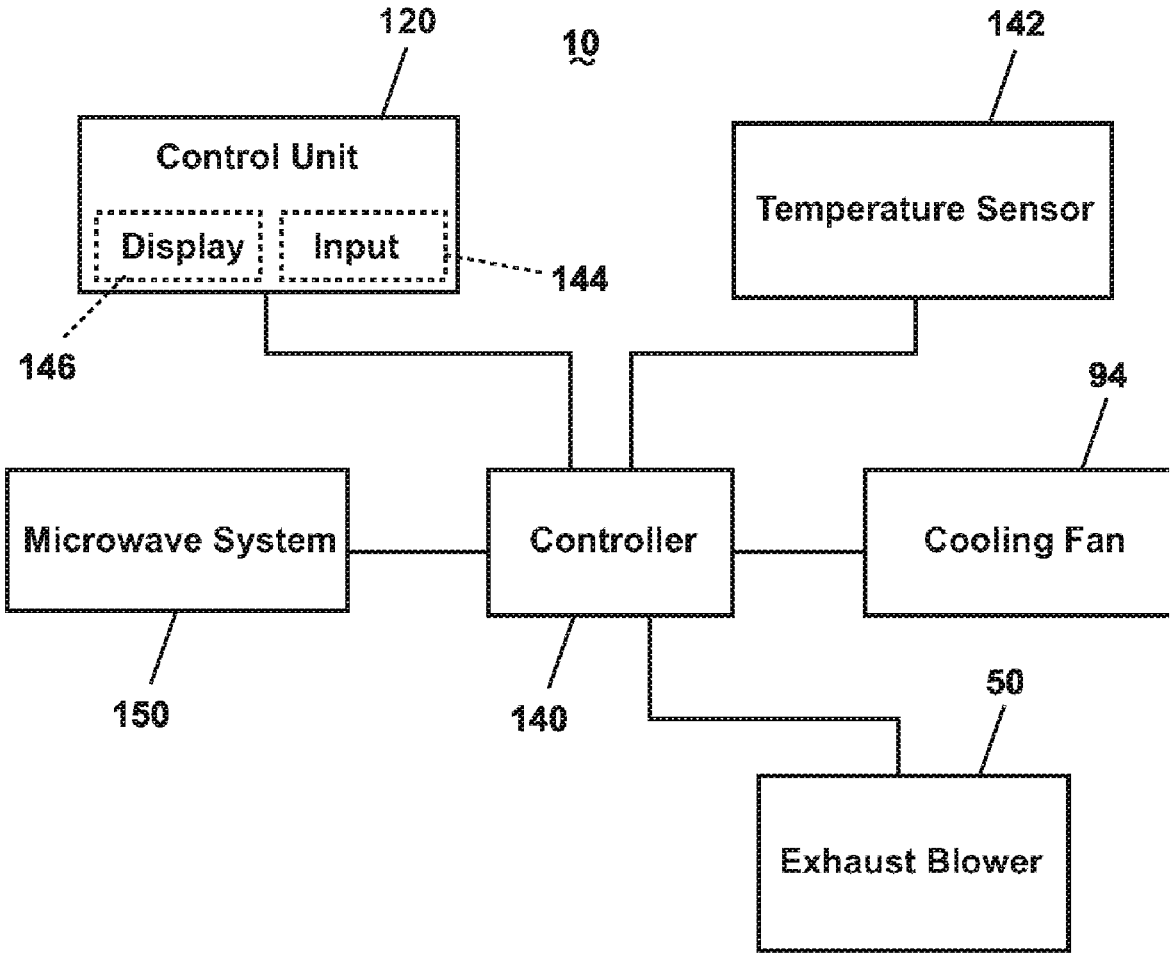
FIG. 7 is a schematic view of the control elements of present invention.

Referring to FIG. 7, the operation of the control elements of the present invention can be understood. A controller 140 is provided for directing the operation of the control elements of the microwave. The controller 140 may be part of or integrated with the control unit 120 supported on the door 26 as discussed above or may be a separate unit. The control unit 120, as discussed above, preferably includes an input system or device 144 and a display element 146, which may be an LCD screen.

A temperature sensor 142 is operatively connected to the controller 140 and is located in a location for sensing the temperature of the control 120. The temperature sensor 142 may be located directly on the control 120 mounted within the door. Alternatively, the temperature sensor may be located on the bottom portion of the door 26 or bottom closure wall 26 where the measure temperature correlates to the temperature of the control 120. The controller 140 is operatively connected to the microwave system 150 which includes the magnetron 90 and high voltage transformer 92. The controller 140 is also operatively connected to the cooling fan 94 and exhaust blower 50 for operating these elements.

During the operation of the microwave oven 10, the cooling fan 94 is also operated so that whenever the microwave oven is in operation, the control unit 120 supported in the door 26 is cooled. Additionally, the temperature sensor 142 may be used to sense temperature at all times, even when the microwave oven is not in operation, so that if an undesirable high temperature is sensed, the cooling fan 94 may be energized to cool the controls 120. This may occur in the case where the present invention is practiced in an OTR microwave where the problem of dissipating heat generated during cooking is increased. The heat dissipation problem is especially difficult when the lower oven and/or cooking hop or cook-top is in operation. During this operation, heat rises from either the oven or cooking hob and may elevate the temperature of the microwave door 26 to an undesirable temperature. In this situation, according to the present invention, the cooling fan system of the microwave 10 would be energized to cool the door mounted control unit 120.

In one embodiment, the present invention provides for a communication message on the display device when the cooling fan 94 is operated independently of the microwave oven 10. This message can communicate that the cooling system of the microwave has been energized due to sensed high temperatures. It may be possible to instruct the user to confirm operation of the cooking hob and/or oven to ensure proper operation or to take steps to reduce the microwave oven temperature.

It can be seen, that a microwave oven having a unique cooling or ventilation system for door mounted controls has been disclosed. The ventilation system uses, the blower provided for cooling the electronic components of the microwave. The invention provides for a channeling of air flow first upwardly and then downwardly with the door to beneficially cool the control unit mounted within the door. The ventilation system can be operated independently of other microwave systems, in response to the sensed temperature of the door mounted controls.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

The invention claimed is:

1. A microwave oven for use in cooking food having a magnetron, comprising:

an external enclosure defining an outer cabinet;

an oven cavity supported within the external enclosure and having a front access opening;

a door rotatably supported adjacent the external enclosure for selectively closing the access opening;

a control unit mounted within the door;

a ventilation cooling path formed within the door for cooling the control unit;

a housing which forms part of the ventilation cooling path supported within the door wherein the control unit is mounted within the housing in the cooling path; and a blower supported within the external enclosure for directing an air flow toward the door and into the ventilation cooling path.

2. The microwave oven according to claim 1, wherein the control unit includes a liquid crystal display on which character data or image data are displayed in plural display areas and a transparent electrode switch sheet in which there are arranged plural transparent electrode switches.

3. The microwave oven according to claim 1, wherein the ventilation cooling path initially directs air upwardly within the housing and then reverses direction to pass air downwardly along the control unit.

4. The microwave oven according to claim 3, wherein the door has a bottom edge and at least one air vent inlet opening located along the bottom edge and air flow from the blower is directed into at least one vent inlet opening, the at least one vent inlet opening supplying air into the ventilation cooling path.

5. The microwave oven according to claim 1, further comprising:

an electrical equipment compartment disposed within external enclosure and wherein the blower supported within the external enclosure is mounted for causing air flow into the electrical equipment compartment;

the external enclosure having a front surface which abuts the door when the door is in a closed position; and an air conduit extending from the electrical equipment compartment toward the front surface of the external enclosure for directing air flow toward the door.

6. The microwave oven according to claim 5, wherein the front face of the external disclosure includes at least one vent exhaust opening to which the air conduit delivers air flow and the door includes at least one air vent inlet opening in alignment with the vent exhaust opening that air flow passes from the external enclosure into the door.

7. The microwave oven according to claim 6, wherein:

the door has a bottom portion and the vent inlet opening is located along the bottom portion, and a baffle is disposed within the housing wherein the housing and baffle for the ventilation cooling path within the door and direct the air flow initially upwardly and then downwardly to pass along the control unit.

8. A microwave oven for use in cooking food having a magnetron, comprising:

an external enclosure defining an outer cabinet;

an oven cavity supported within the external enclosure and having a front access opening;

a door rotatably supported adjacent the external enclosure for selectively closing the access opening;

a control unit mounted within the door;

a ventilation cooling path formed within the door for cooling the control unit;

a housing supported within the door for enclosing the control unit and forming part of the ventilation cooling path;

a baffle disposed within the housing wherein the housing and the baffle direct the air flow initially upwardly and then downwardly to pass along the control unit; and a blower supported within the external enclosure for directing an air flow toward the door and into the ventilation cooling path.

9. The microwave oven according to claim 8, further comprising:

a temperature sensor mounted for sensing the temperature of the control unit and operatively connected to the control unit, wherein the blower is energized for directing air flow toward the ventilation cooling path when an excess temperature condition is sensed.

10. The microwave oven according to claim 9, wherein the temperature sensor may be mounted to the bottom portion of the door.

11. The microwave oven according to claim 9, wherein the temperature sensor may be mounted to the bottom portion of the external enclosure.

12. The microwave oven according to claim 9, wherein the control unit includes a display device which can communicate when the blower is operating to cooling the control unit.

* * * * *